US006474636B2

(12) United States Patent
Adema

(10) Patent No.: US 6,474,636 B2
(45) Date of Patent: Nov. 5, 2002

(54) APPARATUS FOR THE SEPARATION OF SHEETS

(75) Inventor: Sieberen Adema, Drachten (NL)

(73) Assignee: Neopost B.V., Drachten (NL)

( * ) Notice: Subject to any disclaimer, the term of this patent is extended or adjusted under 35 U.S.C. 154(b) by 0 days.

(21) Appl. No.: 10/101,086

(22) Filed: Mar. 21, 2002

(65) Prior Publication Data

US 2002/0089113 A1 Jul. 11, 2002

Related U.S. Application Data

(62) Division of application No. 09/475,120, filed on Dec. 30, 1999.

(30) Foreign Application Priority Data

Dec. 31, 1998 (NL) ..... 1010934

(51) Int. Cl.[7] ..... B65H 3/06
(52) U.S. Cl. ..... 271/109
(58) Field of Search ..... 271/122, 124, 271/125, 123, 109, 33, 119, 120; 399/9, 123; 400/624; 347/216; 358/498; 198/493–497, 499; 221/42, 259, 237, 277, 210

(56) References Cited

U.S. PATENT DOCUMENTS

| | | | | |
|---|---|---|---|---|
| 3,583,555 A | * | 6/1971 | Karsnak et al. | 15/256.5 |
| 3,731,915 A | | 5/1973 | Guenther | |
| 4,004,941 A | * | 1/1977 | Nekula | 134/15 |
| 4,026,648 A | | 5/1977 | Takahashi | |
| 4,370,050 A | | 1/1983 | Matsui et al. | |
| 4,451,139 A | | 5/1984 | Yanagawa et al. | |
| 5,007,507 A | | 4/1991 | Van Der Werff | |
| 5,362,037 A | | 11/1994 | Van Der Werff et al. | |
| 5,740,498 A | | 4/1998 | Tsuchiya | |
| 5,805,958 A | | 9/1998 | Fisk | |
| 6,042,104 A | | 3/2000 | Nishikori et al. | |
| 6,055,407 A | | 4/2000 | Inoue et al. | |
| 6,201,940 B1 | | 3/2001 | Lee | |

FOREIGN PATENT DOCUMENTS

| | | | | |
|---|---|---|---|---|
| EP | 0 737 577 A1 | | 10/1996 | |
| JP | 57-189943 A | | 11/1982 | |
| JP | 60-204543 A | | 10/1985 | |
| JP | 60-248535 A | | 12/1985 | |
| JP | 10-329299 | * | 12/1988 | ..... B41F/9/08 |

* cited by examiner

*Primary Examiner*—Donald P. Walsh
*Assistant Examiner*—Kenneth W Bower
(74) *Attorney, Agent, or Firm*—Burns, Doane, Swecker & Mathis, L.L.P.

(57) ABSTRACT

An apparatus for the separation of sheets includes a transport structure for exerting a force on an outermost sheet of a pack of sheets in the direction of transport and a separation structure for exerting a force on at least one other sheet of the pack against the direction of transport to prevent the other sheet from moving along with the ourtermost sheet in the direction of transport. The apparatus also includes a treating device for treatment of the engaging surface of the transport structure and/or the separation structure to increase the frictional coefficient of the engaging surface. Thus, a more reliable separation effect can be obtained especially over a longer period.

17 Claims, 1 Drawing Sheet

APPARATUS FOR THE SEPARATION OF SHEETS

This application is a divisional of application Ser. No. 09/475,120, filed on Dec. 30, 1999.

FIELD AND BACKGROUND OF THE INVENTION

The invention relates to an apparatus for the separation of sheets.

From practice, many types of apparatuses for the separation of sheets from a stack or from a mutually overlapping situation are known. In separation apparatuses comprising a circulating surface which presses against an outermost sheet or set of sheets with a normal force and exerts a force on the outermost sheet or the outermost set of sheets by means of frictional force in a direction of transport, the problem sometimes arises that the force exerted on the outermost sheet in the direction of transport cannot overcome the frictional forces occurring during the separation so that the sheet or the set of sheets is not taken from the stack but gets stuck in the area of the circulating surface.

This problem especially arises when the circulating surface which must exert the force in the direction of transport ages or soils and when sheets having very smooth but mutually adhering surfaces must be separated. Especially separation apparatuses processing printed and often soiled paper, for instance for the separation of originals in a fax or photocopier or for the separation of documents or enclosures in an enveloping apparatus, suffer from this problem.

As referred to herein, a set of sheets is two or more sheets which are connected or engaged with each other in any way (for instance because they have been folded together).

SUMMARY OF THE INVENTION

It is an object of the invention to increase the reliability of the separation of sheets or sets of sheets from a stack or at least a mutually overlapping situation by means of frictional forces exerted on an outermost sheet.

According to the present invention, this object is achieved by providing an apparatus for the separation of sheets including: a transport structure for exerting a force on an outermost sheet of a pack of sheets in a direction of transport substantially parallel to this sheet; and a separation structure for exerting a force on at least one other sheet of the pack against the direction of transport to prevent the at least one other sheet from moving along with the outermost sheet in the direction of transport, the sheets overlapping each other, at least the transport structure or the separation structure having a rough surface suspended for exerting a force with a normal force component transversely to the outermost sheet and a frictional force component parallel to the direction of transport; further including a treating device intended for treatment of the rough surface to increase the roughness of the rough surface.

Because the apparatus comprises a treating device for increasing the roughness of the circulating surface, the negative effect which soiling and aging have on the roughness can be counteracted and the roughness of the circulating surface can be kept at a higher level, especially over a longer period. This makes it possible to increase the operating reliability of the apparatus. Thus, for instance, the initial reliability can be increased because a deterioration of the roughness of the rollers during assembly and storage can be compensated at least partly. The reliability over a longer period can be increased because the deterioration of the roughness is limited or because the roughness is increased again from time to time. The invention further makes it possible by means of special treatments without manual intervention to bring the roughness to a level which without facilities for the treatment of the rough surface would lead to rapid soiling and a short life span of the rough surface.

Further objects, practical aspects, effects and details of the invention will appear from the following description in which a number of practical examples is described with reference to the drawing. Moreover, special practical aspects of the invention are laid down in the dependent claims.

DETAILED DESCRIPTION

Figure 1:
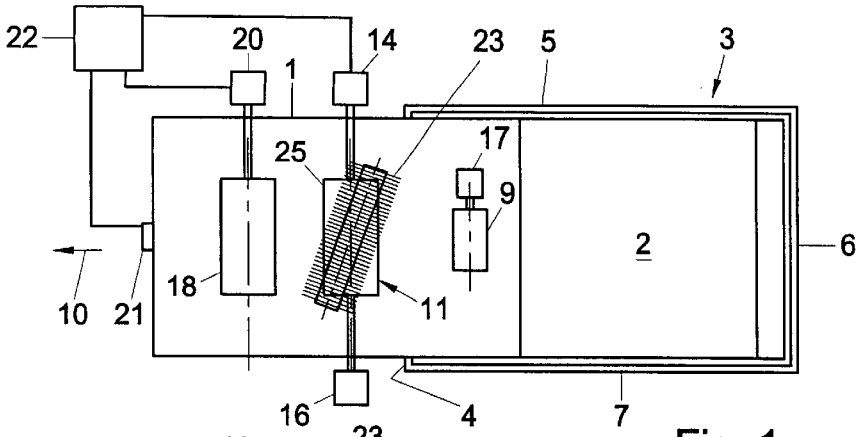
FIG. 1 is a schematic representation in top view of an apparatus according to a practical example of the invention.

Since separation apparatuses which by exertion of frictional forces engage outermost sheets of a stack or a plurality of sheets overlapping each other are known from practice in many forms, the structural embodiment of the separation apparatus will not be discussed in detail in this description, but in the different figures those parts are shown which are directly affected by the invention, and which immediately effect the movement of the sheets. How such elements can be driven and suspended is well known to a skilled person and will therefore not be discussed herein.

The invention will first be explained with reference to the practical example shown in FIGS. 1 and 2, which at this moment is the most preferred embodiment of the invention.

The apparatus according to this example is intended for piece-wise feeding uppermost sheets 1 of a stack 2 stored in a container 3 and guided by walls 4, 5, 6, 7 of this container 3. The walls 4–7 can be adjustable in a known per se manner or are adapted to the paper size to be fed from the container.

The bottom 8 of the container 3 can be moved upwards in a known per se manner to keep the top of the stack 2 is within a specific area near the top of the container 3. An example of such a feature is described in applicants' U.S. Pat. No. 5,007,507, the contents of which are inserted herein by reference.

Within the projected continuation of the area enclosed by the walls 4–7 of the container 3, a feed roller 9 is located at a distance above the bottom 8. When the bottom 8 is in its highest position and the container 3 is empty after a last sheet has been carried off, the feed roller 9 can touch the bottom 8 anyway. Located at a distance in a direction of transport 10 approximately parallel to the bottom 8 of the feed roller 9 is a transport roller 11. On the same side of the transport roller 11 as the bottom 8, a separation roller 12 is located exactly below this transport roller 11, This separation roller is elastically forced against or at least nearly against the transport roller 11 by a spring force 13. The transport roller 11 is coupled with a drive 14 for driving the transport roller 11 in such a rotating sense that a frictional force is exerted on a sheet 1 in the direction of transport 10 by the transport roller 11 in a nip between the transport roller and the separation roller 12. rotates it in the sense of transport, with the coupling 15 slipping.

Also when a sheet 1 enters the nip between the transport roller 11 and the separation roller 12, the separation roller 12 is taken along by this sheet 1 in the sense of transport. However, the couple transmitted by the coupling 15 is adjusted such that the separation roller 12 is rotated against the sense of transport when two or more sheets enter the nip between the transport roller 11 and the separation roller 12. These sheets are then forced back against the direction of transport. Friction with respect to the sheet moving in the direction of transport 10 and friction with respect to the stack 2 must be overcome. Furthermore, the static frictional force between two mutually not moving sheets in the nip between the transport roller 11 and the separation roller 12 must also be overcome to displace these sheets with respect to each other. On the side of the transport roller 11, an additional force must be exerted in the direction of transport each time when after forcing back a double sheet, the circumference of the separation roller 12 contacts the single sheet and the rotating sense of the separation roller 12 must be reversed again This imposes stringent requirements on the frictional coefficient between the outer circumferences of the transport roller 11 and the separation roller 12 and transported paper.

The transport roller 11 and the separation roller 12, at least when one or more sheets are present between them, are pressed against each other by a normal force. By increasing this normal force, the traction of the rollers 11, 12 can be improved, but then the friction between sheets to be separated from each other in the nip between the transport roller 11 and the separation roller 12 is also increased.

Figure 2:
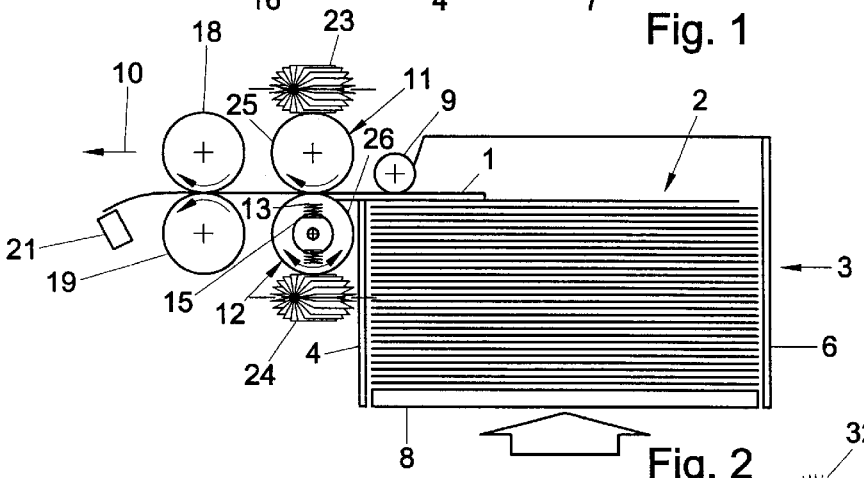
FIG. 2 is a schematic representation in cut-away side view of the apparatus according to FIG. 1.

In the apparatus according to FIGS. 1 and 2, the reduction of the frictional coefficient of the outer circumferential surfaces of the rollers 11, 12 is positively affected because the apparatus comprises treating devices 23, The separation roller 12 is coupled via a slip coupling 15 with a drive 16 which drives the separation roller 12 in such a rotating sense that circumferential portions facing the transport roller 11 are always driven against the direction of transport 10.

The feed roller is also coupled with a drive 17 which is arranged to drive each outermost sheet 1 over a short distance until it has reached the nip between the transport roller 11 and the separation roller 12. Preferably, the geometry of the suspension of the feed roller 9 is such that the normal force exerted by it is greater when it exerts a force in the direction of transport 10 than when it does not exert a force in the direction of transport. Further details concerning the variation of the normal force exerted by the feed roller depending on the frictional force exerted by this roller 9 appear from applicants' U.S. Pat. No. 5,362,037, the contents of which are inserted herein by reference.

Located downstream of the transport roller 11 and the separation roller 12 are two transport rollers 18, 19 which either transport a sheet further or transport it until it has reached a waiting position. In order to watch whether a sheet has reached the waiting position, a sensor 21 is positioned downstream of the transport rollers 18, 19. This sensor itself is coupled with a control system 22 which is actively coupled with the drives 14, 20 of the transport rollers 11, 18 to activate them each time in response to a command to feed a sheet until a leading edge of a next sheet 1 has reached the sensor 22.

In operation, a separation cycle begins each time by feeding an outermost sheet 1 of the stack 2 by the feed roller 9 to the nip between the transport roller 11 and the separation roller 12. As long as no sheet is present between the transport roller 11 and the separation roller 12, the separation roller 12 is taken along by the transport roller 11—against the outer circumference of which lies the outer circumference of the separation roller—and thus also 24 in the form of brushes arranged for treatment of the rough outer circumferential surfaces 25, 26 of the rollers 11, 12 to increase the roughness of the rough outer circumferential surfaces 25, 26.

Through these brushes, dirt, such as paper dust, greasy deposits, sediments of printing ink and paper finishes and silicones, is removed from the outer circumferential surfaces 25, 26 of the rollers 11, 12. Furthermore, the outer circumferential surfaces 25, 26 can be roughened if the brushes are stiff and hard enough. Through these effects, a decrease of the roughness of the rollers owing to soiling and aging is inhibited to a substantial degree so that the life of the rollers can be appreciably extended with a given minimum of reliability. Furthermore, the use of such treating facilities enables the use of softer rubbers which are more sticky and would therefore soil too rapidly in the absence of a treating provision.

Although, as will hereinafter be discussed, solutions in which the treating facilities are not slidingly moved over the circumferential surfaces 25, 26, are also possible, an embodiment in which the treating facilities 23, 24 can be rubbed along the rough circumferential surfaces is preferred because an effective improvement of the roughness of the circumferential surfaces can thus be effected in a structurally very simple manner and at low cost. Moreover, new supply goods are not frequently required.

The fact that the treating facilities are formed by brushes 23, 24, the bristles of which are in contact with the rough surface, offers the advantage that a uniform cleaning effect is obtained and no or little tendency towards spreading of dirt arises, also when the brushes 23, 24 have been in use for a long time.

Because in the apparatus according to FIGS. 1 and 2 the rough surfaces 25, 26 are circulating surfaces arranged to come into contact with the brushes while circulating, they can be simply treated during circulation without requiring special facilities in order that all the surface portions of the rough surfaces 25, 26 effective in operation can be reached.

Because the treating devices, in this example in the form of brushes 23, 24, can be circulated, a uniform treating effect is obtained.

Furthermore, in the example according to FIGS. 1 and 2, the rough surfaces 25, 26 and the treating devices 23, 24 are each coupled with a common drive 16, 18 for circulating the rough surfaces 25, 26 and the brushes 23, 24. Consequently, no separate source of power is required to circulate or, more in particular, rotate the brushes 23, 24.

Because, in the operating condition, the brushes 23, 24 are coupled with the common drive 16, 20 via the rough circumferential surface to be treated, no separate transmission is required to rotate the brushes 23, 24.

Furthermore, the brushes 23, 24 and the rough circulating surfaces 25, 26 can circulate along paths of which portions, in an area where the brushes 23, 24 and the circulating rough surfaces to be treated are in contact with each other, extend at such an angle with respect to each other that portions of the brushes 23, 24 move in this area over the circulating rough surface 25, 26 transversely to a local direction of movement of this rough surface.

In the apparatus according to the example shown in FIGS. 1 and 2, this is further realized because the brushes 23, 24 are each suspended for rotation about a rotation axis and each of these rotation axes is directed at an inclined angle with respect to a circulating path of the corresponding rough surface in the area where the brushes 23, 24 and the relevant one of the circulating rough surfaces 25, 26 are in contact with each other. Furthermore, the rough surfaces, too, are each suspended for rotation about a rotation axis. These rotation axes themselves are each directed at an inclined angle with respect to the path of the corresponding rush 23, 24 in the area where this brush 23, 24 and the corresponding circulating rough surface 25, 26 are in contact with each other.

Through these orientations of the rotation axes of the brushes 23, 24, the brushes 23, 24, on the one hand, are taken along by the rollers 11, 12 to be treated by them, so that no separate drive is required, but the brushes 23, 24, on the other hand, move over the circumferential surfaces 25, 26 of the rollers 11, 12, which are to be treated, with an axial component so that the intended cleaning and optionally roughening effect is obtained.

Figure 3:
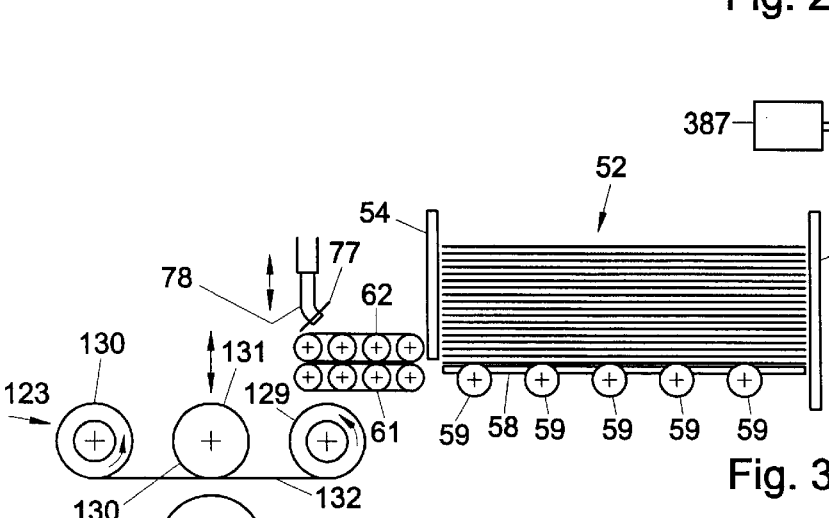
FIG. 3 is a representation in accordance with FIG. 2 of an apparatus according to a second practical example.

FIG. 3 shows an alternative practical example in the form of an apparatus for piece-wise feeding sheets from the bottom of a stack. This apparatus has guide walls 54, 55, a bottom 58 for supporting a stack 52 and feed rollers 59 extending upwards through this bottom.

Located downstream of the stack 52 is a portion of a transport path with circulating bands 61, 62 of which the subjacent circulating band 61 forms a band conveyor and the superjacent circulating band 62 forms a separation band.

In order that the bands can be kept rough, the apparatus comprises a chisel-like tool 77 supported by a vertically adjustable support 78 and having a cutting edge which, in the active operating condition, is in contact with the circulating rough surface. With this chisel-like tool 77, a portion of the top layer can be cut from the circulating band 62 in a simple manner so that an aged and/or soiled top layer can be cut from the band 62. The tool 77 may also be of a different design, such as, for instance, a scraper.

Figure 4:
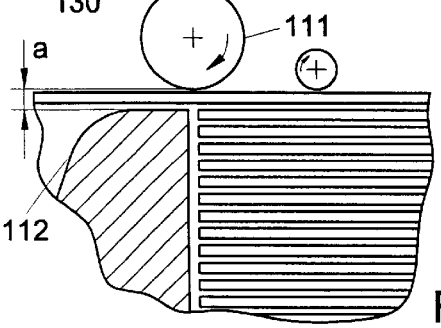
FIG. 4 is a partial representation in cut-away side view of an apparatus according to a third practical example.

FIG. 4 shows an example relating not to friction separation but to slit separation in which a distance a between the transport roller and a separation block 112 determines whether a next sheet can be fed and passed through or not.

For treating the transport roller 111, the apparatus according to this example comprises a treating device 123 in the form of an adhesive band feeder having a feed reel 129, a take-up reel 130 and an intermediate pressing roller 131 suspended for movement towards the transport roller 111 and away from the transport roller 111. When the pressing roller 131 is forced to the transport roller, a cleaning band 132 having a sticky surface comes into contact with the circulating surface of the transport roller 11 while unwinding from the feed reel 129 and winding on the take-up reel 130. The sticky surface thereby takes along dirt from the circumferential surface of the transport roller so that the frictional force which the transport roller 111 can exert on a sheet with a given normal force is increased.

Optionally, it may also be provided that sticky material is deposited on the circumferential surface of the transport roller 111 and is regularly changed, if required, so that the frictional coefficient of this roller may be strongly increased.

Figure 5:
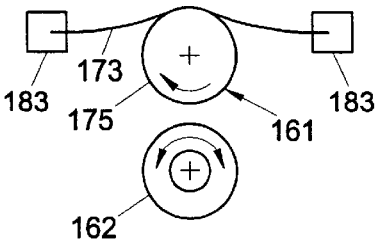
FIG. 5 is a representation of only rollers and a treating device of an apparatus according to a fourth practical example.

FIG. 5 show a further variant in which the treating device 173 for treating the circumferential surface 175 is formed by an abrasive surface which, in the active operating condition, is in contact with the rough circulating surface of a transport roller 161. In this example, the abrasive surface is a surface of a piece of abrasive cloth stretched between two stretchers 183 and thereby pressed against the circumferential surface 175 of the transport roller 161 to scour and roughen it. Located opposite the transport roller 161 is a separation roller 162, for which a treating device for increasing the frictional coefficient of the circumferential surface thereof may optionally also be provided.

Figure 6:
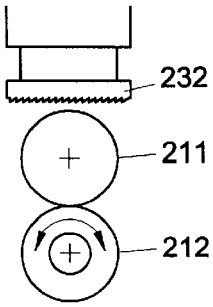
FIG. 6 is a representation in accordance with FIG. 5 of an apparatus according to a fifth practical example.

The abrasive surface, however, may also be a textile surface from hard fibers or a filing surface. An example of the latter is given in FIG. 6, which shows a transport roller 211, a separation roller 212 and a file 232 for treating the circumferential surface of the transport roller 211. A similar type of file could also be used to treat the circumferential surface of the separation roller 212.

Figure 7:
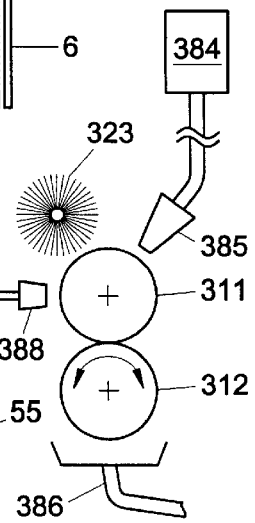
FIG. 7 is a representation in accordance with FIG. 5 of an apparatus according to a sixth practical example.

FIG. 7 shows a device which comprises a cleaning liquid reservoir 384 and an applicator in the form of a spray nozzle 385 for applying a cleaning liquid onto the rough surface of a transport roller 311. By applying cleaning liquid, dirt can be detached better in many cases than by dry cleaning only. To remove dirt detached by the cleaning liquid, a rotatable brush 323 is provided, which can be pressed against the transport roller 311. Located below the transport roller is a separation roller 312, for which similar cleaning facilities may optionally be provided.

Located below the separation roller 312 is a collecting vessel 389 for collecting cleaning liquid with a discharge hose 386.

In order that the roughness of the rollers 311, 312 can be further increased, the apparatus according to this example further comprises a reservoir 387 for an adhesive medium and an applicator in the form of a spray nozzle 388 for applying an adhesive medium onto the rough surface of the transport roller 311. Thus, the rough surface of the transport roller 311 can be made slightly sticky, which enables a very effective separation. Because a sticky surface very rapidly soils, it is highly advantageous if the rough surface is made sticky in combination with the cleaning of the rough surface by means of liquid because then soiled adhesive can always readily be removed from the rough surface. The applicators for applying cleaning liquid (may also be clean water) or sticky material may of course also be of a different design, for instance in the form of brushes, sponges or elements of textile material.

From the foregoing, it will be clear to a skilled person that many other variants of the invention than those shown herein are possible.

What is claimed is:

1. An apparatus for the separation of sheets comprising:

a transport structure for exerting a force on an outermost sheet of a pack of sheets in a direction of transport substantially parallel to said sheet;

a separation structure for exerting a force on at least one other sheet of said pack against the direction of transport to prevent said at least one other sheet from moving along with said outermost sheet in the direction of transport, said sheets overlapping each other, at least the transport structure or the separation structure having a surface suspended for exerting a force with a normal force component transverse to said outermost sheet and a frictional force component parallel to the direction of transport, said surface possessing a frictional coefficient;

a treating device for treatment of said surface of the at least one of the transport structure and the separation structure to increase the frictional coefficient of said surface; and an applicator for applying a liquid onto said surface.

2. An apparatus according to claim 1, wherein said applicator is adapted for applying a cleaning liquid onto said surface.

3. An apparatus according to claim 2, wherein said treating device has a collecting structure for collecting cleaning liquid.

4. An apparatus according to claim 1, wherein said applicator is adapted for applying an adhesive onto said surface.

5. An apparatus according to claim 1, wherein said treating device further comprises a liquid reservoir for liquid to be supplied to said surface.

6. An apparatus according to claim 1, wherein said treating device is a treating device that is adapted to circulate.

7. An apparatus according to claim 1, wherein the treating device is slidable over said surface.

8. An apparatus according to claim 7, wherein said treating device comprises a brush with bristles which are in contact with said surface.

9. An apparatus according to claim 8, wherein free ends of said bristles are in contact with said surface.

10. An apparatus according to claim 7, wherein said treating device has an abrasive surface, a filing surface or a textile surface from hard fibers which, in at least an operating condition, is in contact with said surface.

11. An apparatus according to claim 7, wherein said treating device has at least a cutting edge which, in at least an operating condition, is in contact with said surface.

12. An apparatus according to claim 1, wherein said surface is a circulating surface arranged to come into contact with said treating device while circulating.

13. An apparatus according to claim 12, wherein said treating device is adapted to circulate and wherein said surface and said treating device are coupled with a common drive for circulating said rough surface and said treating device.

14. An apparatus according to claim 13, wherein said treating device, at least in an operating condition, is coupled with said common drive via said surface.

15. An apparatus according to claim 14, wherein said treating device and said surface are adapted to circulate along paths of which portions, in an area where said treating device and said surface are in contact with each other, extend at such an angle with respect to each other that portions of the treating device move in said area over said surface transverse to the direction of movement of said surface.

16. An apparatus according to claim 15, wherein said treating device is suspended for rotation about a rotation axis and wherein the rotation axis is transverse to the path of said surface in said area where said treating device and said surface are in contact with each other.

17. An apparatus according to claim 15, wherein said surface is suspended for rotation about a rotation axis and wherein the rotation axis is transverse to a circulation path of said treating device in said area where said treating device and said surface are in contact with each other.

* * * * *